United States Patent [19]

Mui et al.

[11] Patent Number: 5,024,547

[45] Date of Patent: Jun. 18, 1991

[54] WRITING UTENSIL WITH NOTEPAPER

[76] Inventors: Paul Y. H. Mui; Rosa Y. M. Tso, both of 118 Tammy Cir., W. Pittsburg, Calif. 94565

[21] Appl. No.: 455,702

[22] Filed: Dec. 21, 1989

[51] Int. Cl.[5] ..... B43K 29/12; B43K 29/00

[52] U.S. Cl. ..... 401/195; 242/55.53; 401/52

[58] Field of Search ..... 242/55.53; 401/195, 401/52

[56] References Cited

U.S. PATENT DOCUMENTS

| | | | |
|---|---|---|---|
| 640,543 | 1/1900 | Donning | 401/52 X |
| 1,212,020 | 1/1917 | Contant, Jr. | 242/55.53 |
| 1,359,725 | 11/1920 | Moore | 401/52 |
| 2,224,470 | 12/1940 | Boust | 401/52 X |
| 2,512,168 | 6/1950 | Moore | 401/195 X |
| 2,601,650 | 6/1952 | Walter et al. | 401/52 X |
| 3,963,358 | 6/1976 | Houser | 401/195 |
| 4,088,276 | 5/1978 | Littleton | 242/55.53 |

FOREIGN PATENT DOCUMENTS

| | | | |
|---|---|---|---|
| 451884 | 11/1927 | Fed. Rep. of Germany | 401/195 |
| 591789 | 3/1932 | Fed. Rep. of Germany | 401/52 |
| 723179 | 4/1932 | France | 401/52 |
| 1043580 | 11/1953 | France | 401/195 |
| 8806976 | 9/1988 | World Int. Prop. O. | 401/195 |

*Primary Examiner*—Steven A. Bratlie

*Attorney, Agent, or Firm*—Townsend & Townsend

[57] ABSTRACT

A writing apparatus (2) for holding notepaper (10) on a writing utensil. The writing apparatus may be self-contained (2, 102) or may be constructed as an adaptor (202) for use in conjunction with a standard size writing utensil (260). The writing apparatus includes an outer casing (4) for retaining a pencil lead or ink cartridge (20) centrally within the casing. Notepaper is carried by a hollow cylindrical member (6) through which the pencil lead or ink cartridge may be inserted. The casing includes a slot (12) for dispensing the notepaper. A paper control lock (14) is disposed adjacent an outer surface of the casing and extends into the slot. In its normal position, the paper control locks retains the notepaper within the casing. In order to dispense the notepaper, the paper control lock is released thereby permitting the notepaper to dispense through the slot. The writing apparatus may include a knob (18) for remotely dispensing the notepaper or the notepaper may be manually dispensed by pulling the paper through the slot.

1 Claim, 6 Drawing Sheets

WRITING UTENSIL WITH NOTEPAPER

BACKGROUND OF THE INVENTION

This invention relates to a pen and paper holder.

A person may often find that a writing utensil is available, but be unable to locate any paper. Numerous devices have been constructed, incorporating a writing utensil and a pad of paper. Often, however, the pen and paper are separated, defeating the purpose of the combination.

SUMMARY OF THE INVENTION

The present invention relates to a writing apparatus for holding notepaper on a writing utensil. The writing apparatus includes a casing for holding a pencil lead or ink cartridge centrally therein. A hollow cylindrical member extends through the center of the casing to properly position the ink cartridge or pencil lead. A roll of paper is held on the hollow cylindrical member in a paper compartment formed between the exterior of the hollow cylindrical member and the interior of the casing. The paper is dispensed through a slot formed in the casing.

A paper control lock is disposed adjacent an outer surface of the casing and extends into the slot. In a preferred embodiment, a grip is formed on an undersurface of the paper control lock so as to maintain and position the notepaper. Thus, the notepaper will neither dispense through the slot nor rewind into the paper compartment without release of the paper control lock.

The writing utensil may be either a pen or a pencil; however, for ease of reference, the writing utensil will be referred to below as a pen having an ink cartridge. It is to be understood that the writing utensil could alternatively be a pencil having a pencil lead.

In one embodiment, the writing utensil may be self-contained such that the ink cartridge and paper compartment are both housed within the casing. In this embodiment, the hollow cylindrical member is a hollow center pin through which the ink cartridge is inserted.

In an alternate embodiment, the writing apparatus is constructed as an adapter for receiving a standard size pen or pencil. In this embodiment, the hollow cylindrical member receives the entire pen or pencil. The notepaper is held within a compartment formed between the pen or pencil holder and the outer casing.

The present invention may include a mechanism for advancing the notepaper to be dispensed through the slot.

The advancing mechanism may include a knob is disposed on a first end of the casing for remotely advancing the notepaper. The knob includes a counterbore in which a second, noncircular pin resides. A toothed wheel, having a bore formed therethrough conforming to the outer configuration of the second noncircular pin, rotates with the knob and center pin for releasing the paper control lock and, thereby, dispensing the notepaper.

Alternatively, the advancing mechanism may include a depression formed in the paper control lock. In this embodiment, the user lifts the paper control lock and may then pull the notepaper from the casing.

Other features and advantages will appear from the following description in which the preferred embodiments have been set forth in detail in conjunction with the accompanying drawings.

DETAILED DESCRIPTION OF THE PREFERRED EMBODIMENTS

Figure 1:
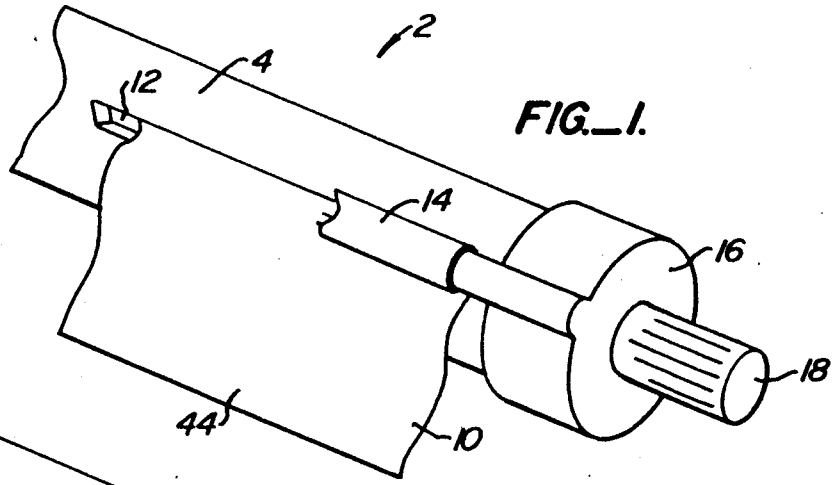
FIG. 1 is a perspective view of a first embodiment of the present invention.

Referring now to the drawings, FIGS. 1–10 illustrate various embodiments of writing apparatus constructed in accordance with the present invention.

Writing apparatus 2, as seen in FIGS. 1–5, includes a casing 4 having a hollow cylindrical member 6 centrally disposed therein. A paper compartment 8 is formed between the exterior of hollow cylindrical member 6 and the interior of casing 4. One end of paper compartment 8 is closed by a cap 16 disposed on first end 5 of casing 4. Notepaper 10 surrounds hollow cylindrical member 6 within paper compartment 8. An end 44 of notepaper 10 extends through a slot 12 formed longitudinally in casing 4.

A paper control lock 14 is disposed on the outer surface of casing 4 parallel to slot 12 for preventing notepaper 10 from dispensing through the slot or rewinding into paper compartment 8. Notepaper 10 is remotely dispensed through slot 12 by a knob 18 extending through cap 16.

A writing means 20 in the form of a pencil lead or ink cartridge extends through the hollow center of cylindrical member 6. As seen in FIGS. 1–5, cylindrical member 6 is in the form of a center pin. An enlarged, noncircular section 22 is attached to center pin 6 at the end opposite first end 5 of casing 4. Knob 18 includes a counterbore 24 in communication with the interior of cap 16. A second, noncircular pin 26 is in mating engagement with counterbore 24 at one end and with center pin 6 at its opposite end. Noncircular pin 26 fits within counterbore 24 at one end and at its opposite end includes a bore into which center pin 6 is received.

Toothed wheels 28, 30 for releasing paper control lock 14 cooperate with enlarged noncircular section 22 of center pin 6 and second noncircular pin 26, respectively. Each toothed wheel 28, 30 includes a noncircular bore 32, 34 through which enlarged section 22 and second pin 26 mate, respectively.

Figure 4:
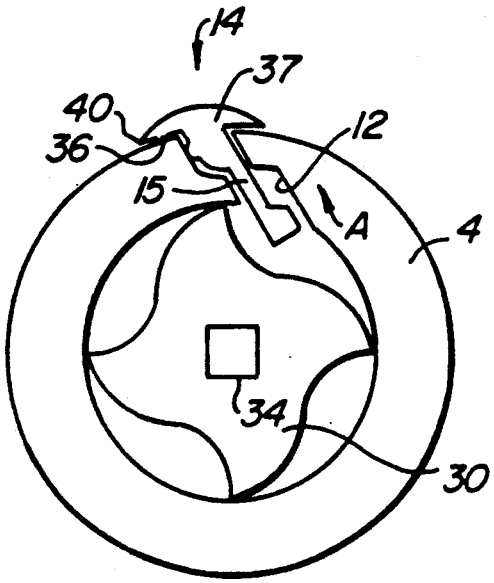
FIG. 4 is a cross-sectional view taken through line 4—4 of FIG. 2.
Figure 5:
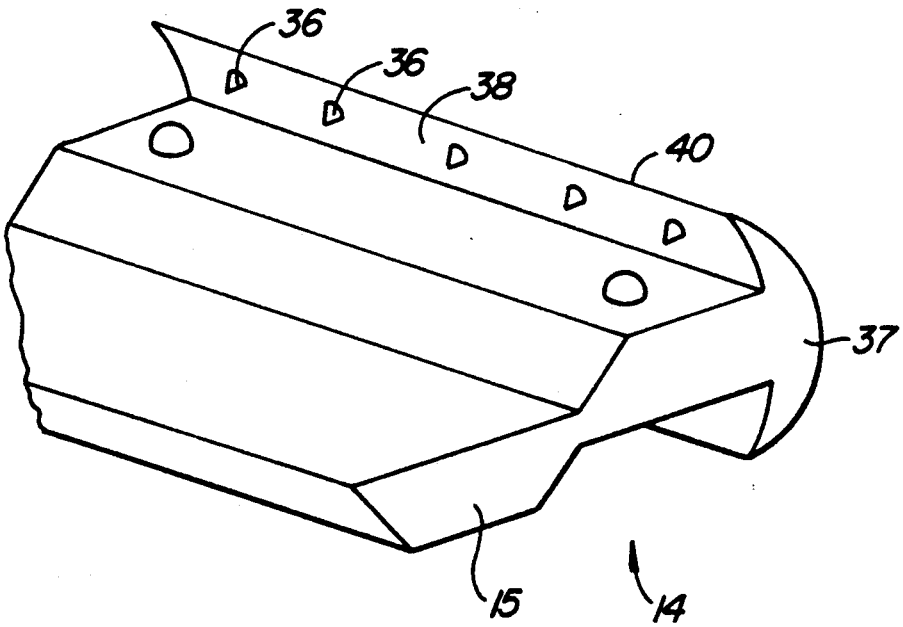
FIG. 5 is a perspective view of the paper control lock as shown in FIG. 4.

Turning now to FIGS. 4 and 5, paper control lock 14 retains notepaper 10 within casing 4. Paper control lock 14 includes a retaining portion 37 disposed adjacent the outer surface of casing 4. Retaining portion 37 is wider than slot 12 so that retaining portion 37 remains on the exterior of casing 4. Protrusions 36 are disposed on an undersurface 38 of retaining portion 37. A tearing edge 40 is formed on one edge of retaining portion 37 adjacent protrusions 36. An extension 15 projects radially inwardly from retaining portion 37 through slot 12 into paper compartment 8. Paper control lock 14 is released through cooperation of extension 15 and the teeth of wheels 28, 30, to be described in detail below.

A stabilizing ring 42 is disposed within casing 4 and surrounds writing means 20.

The operation of writing apparatus 2 will now be described. Notepaper 10, disposed on a roll, surrounds the center of pin 6 within paper compartment 8. An end 44 of notepaper 10 (see FIG. 1) extends through slot 12 and is retained in place by protrusions 36 of paper control lock 14. With notepaper 10 in its normal position, writing apparatus 2 may be used as a conventional writing utensil.

If the writer wishes to withdraw notepaper 10 from compartment 8, he or she rotates knob 18. Because second, noncircular pin 26 mates within counterbore 24 of knob 18, as the knob is rotated, second pin 26 rotates as well. The noncircular engagement between second pin 26 and toothed wheel 30 results in rotation of toothed wheel 30. Additionally, toothed wheel 28 rotates with knob 18 in the same manner.

Turning now to FIG. 4, rotation of wheels 28, 30 releases paper lock 14 from its engaging position. The teeth of wheels 28, 30 move extension 15 upwardly in the direction of arrow A as seen in FIG. 4. Thus, protrusion 36 no longer grips notepaper 10, which may then be dispensed. As the teeth of the wheels rotate, extension 15 and, paper lock 14 with it, returns to its gripping position as seen in FIG. 4. The desired length of notepaper may be dispensed from paper compartment 8 and torn at tearing edge 40 of paper lock 14.

Figure 6:
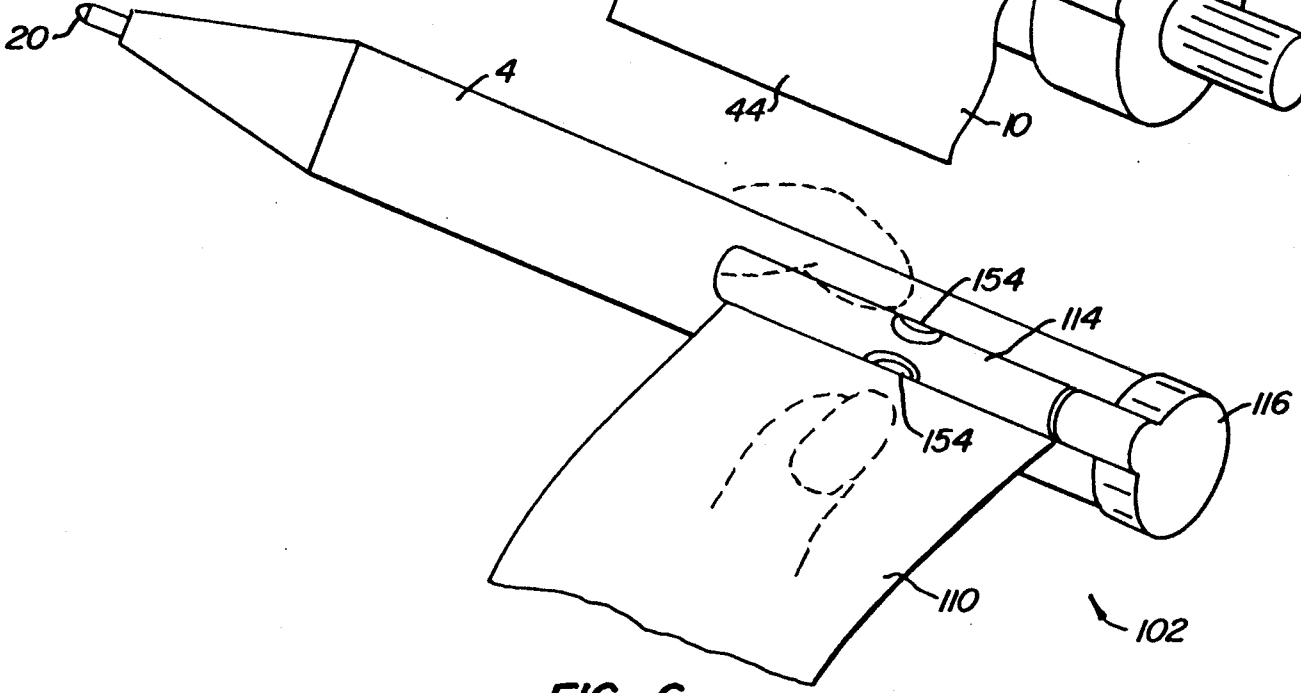
FIG. 6 is a perspective view of a second embodiment of the present invention.
Figure 2:
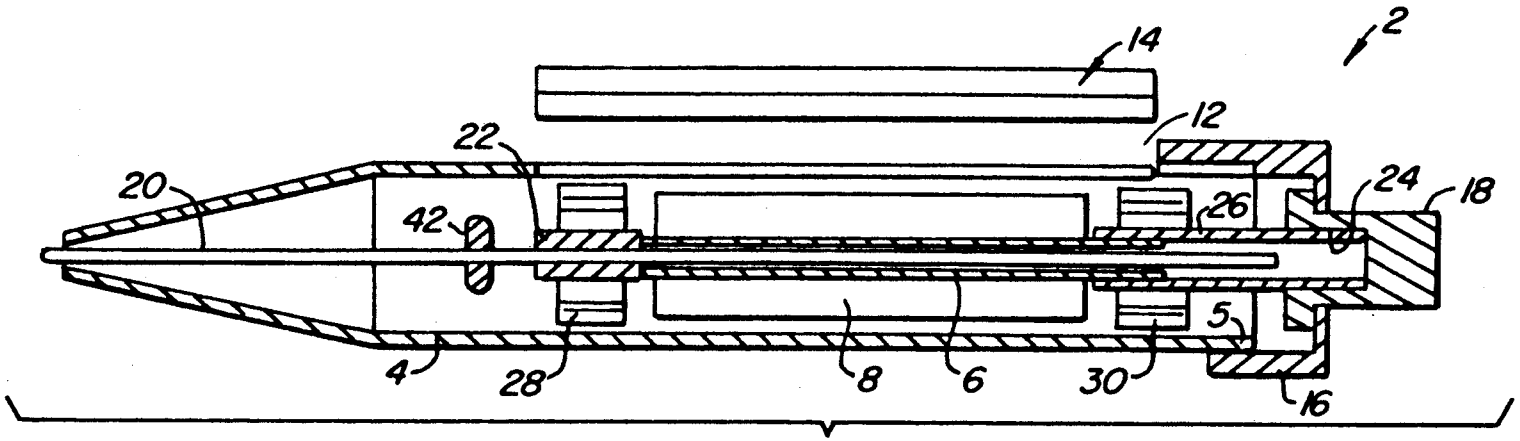
FIG. 2 is a cross-sectional view of the apparatus shown in FIG. 1.
Figure 8:
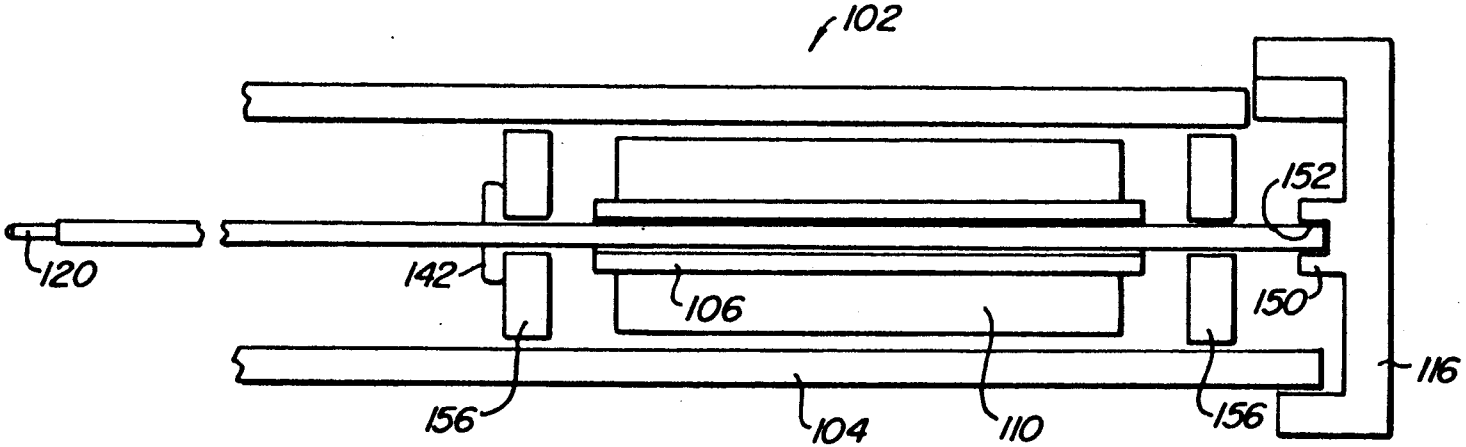
FIG. 8 is a cross-sectional view of the embodiment of FIG. 6.
Figure 3:
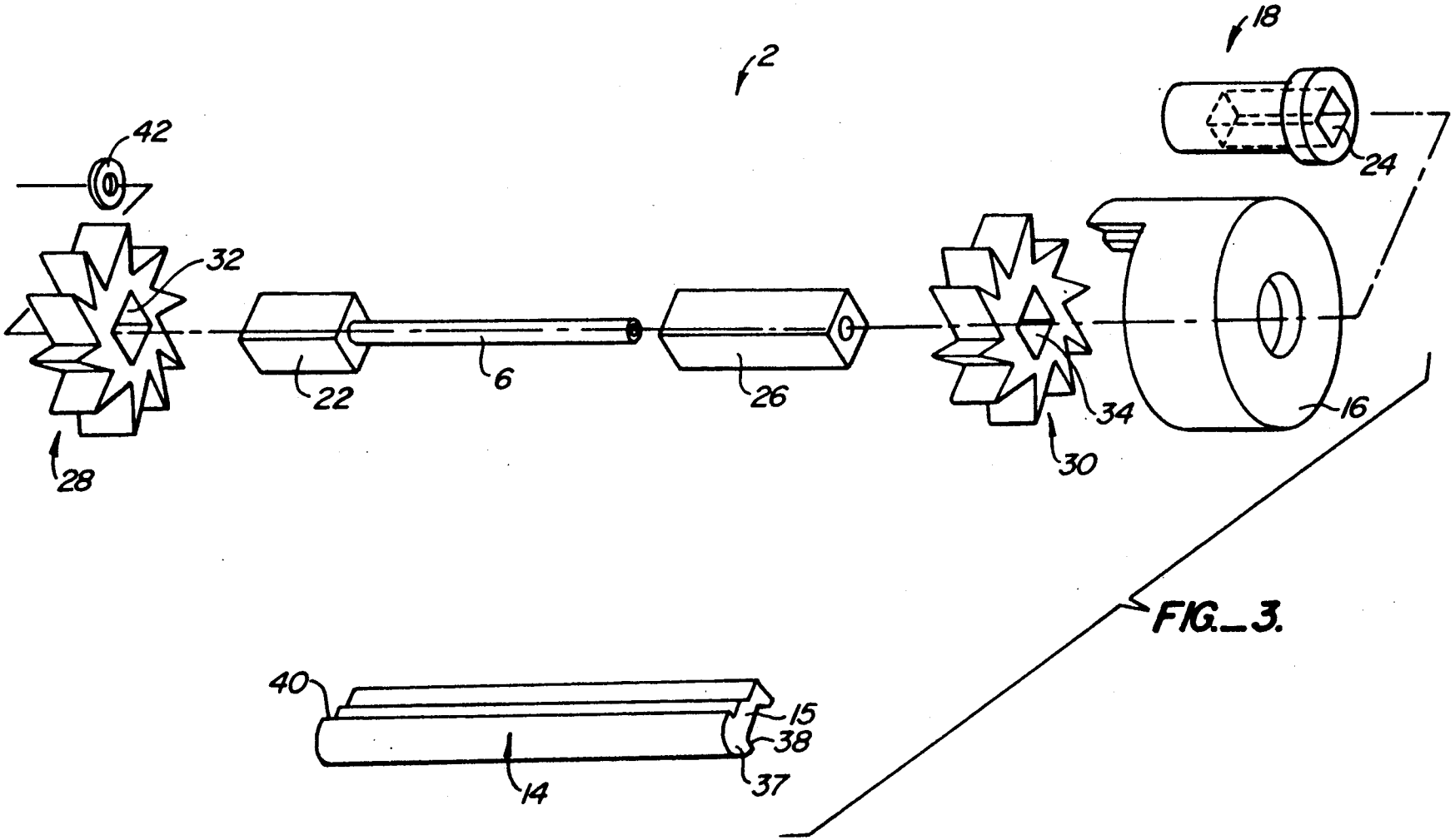
FIG. 3 is an exploded view of the embodiment of FIG. 1.
Figure 7:
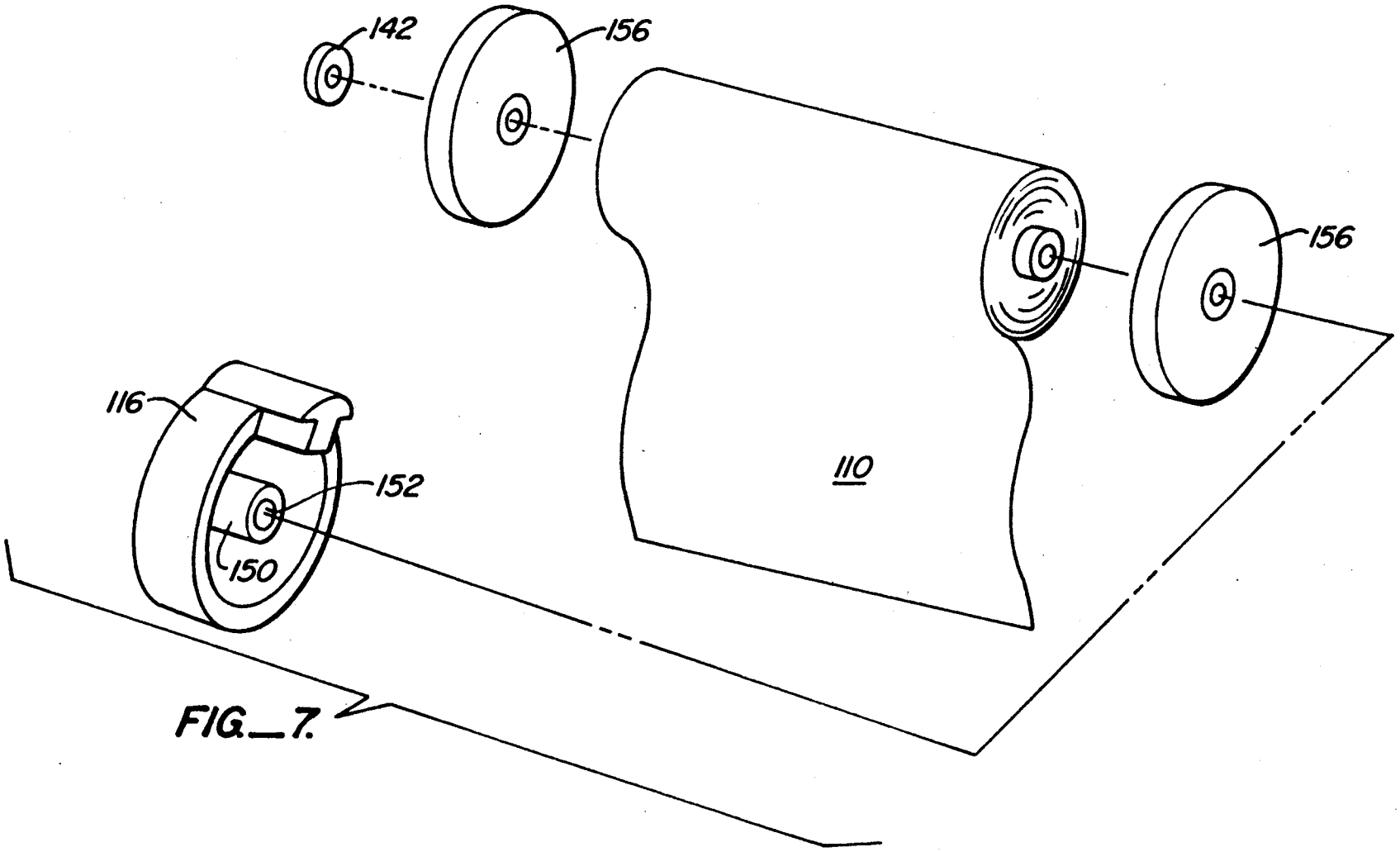
FIG. 7 is an exploded view of the embodiment of FIG. 6.

FIGS. 6–8 disclose a modified form of a writing apparatus. Like reference numerals correspond to reference numerals of the embodiment of FIGS. 1–5, incrementally increased by 100.

Writing apparatus 102 is similar to the embodiment as illustrated in FIGS. 1–5. However, writing apparatus 102 does not include a knob for remotely advancing the notepaper. Thus, cap 116 is closed at its outer surface. A guide 150 extends axially inwardly on the interior of cap 116. Guide 150 forms an indentation 152 which retains writing means 120 centrally within casing 104. Second stabilizing rings 156 are disposed around writing means 120 between the writing means and the inner surface of casing 104.

Rather than employing toothed wheels as seen in the embodiment of FIGS. 1–5, the embodiment of FIGS. 6–8 includes depressions 154 formed in paper control lock 114. (See FIG. 6.)

The operation of the embodiment of FIGS. 6–8 will now be described. The user engages depressions 154 with his or her fingers and pulls outwardly. This releases the grip of paper control lock 114. Notepaper 110 may then be manually pulled through slot 112. The desired length of notepaper 10 is withdrawn from paper compartment 108. Paper control lock 114 is returned to its normal position so that notepaper 110 can be torn at tearing edge 140.

Figure 9:
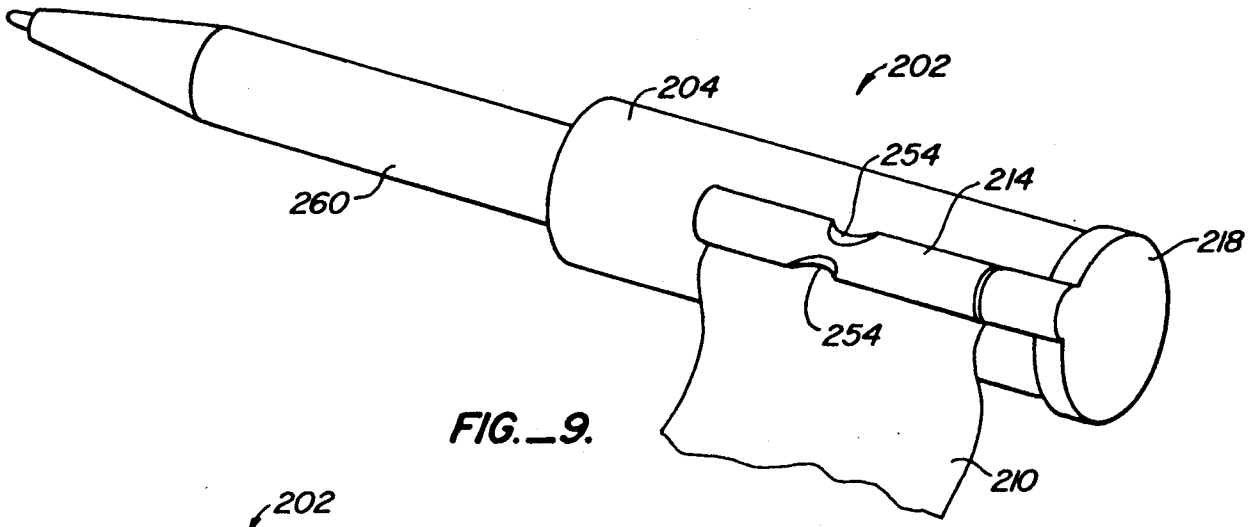
FIG. 9 is a perspective view of a third embodiment of the present invention.
Figure 10:
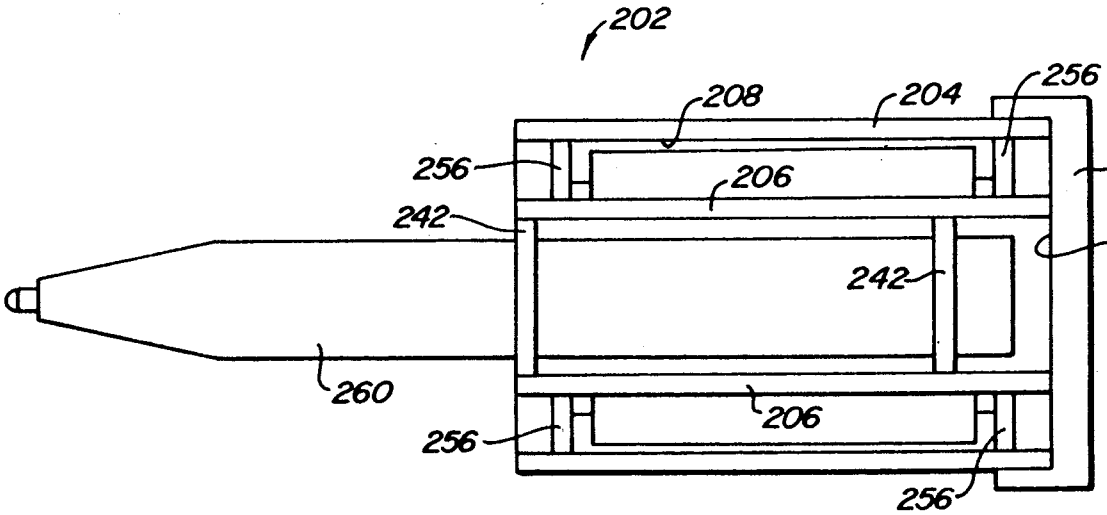
FIG. 10 is a cross-sectional view of the embodiment seen in FIG. 9.

FIGS. 9 and 10 illustrate a third embodiment of the writing apparatus. Like reference numerals correspond to reference numerals of the embodiment of FIGS. 1–5 incrementally increased by 200. The embodiment of FIGS. 9 and 10 is an adapter for use with a standard size writing utensil such as a pen or pencil. Writing apparatus 202 is manually operable as discussed with reference to the embodiment of FIGS. 6–8.

The hollow cylindrical member of the embodiment of FIGS. 9 and 10 is in the form of a pen holder 206. Writing apparatus 202 differs from the previous embodiments in that hollow cylindrical member 206 receives a standard size pen or pencil 260. Notepaper 210 is disposed within paper compartment 208 surrounding pen or pencil 260. First stabilizing rings 242 securely retain pen or pencil 260 within opening 262. Second stabilizing rings 256 are disposed between the exterior of pen holder 206 and the interior of outer casing 204. Pen holder 206 extends centrally inward from the interior of cap 216.

The operation of the embodiment of FIGS. 9 and 10 is identical to the operation of the embodiment of FIGS. 6–8.

This invention has been described with reference to the preferred embodiments. Variations and modifications can be made without departing from the scope of this invention which is limited only by the following claims. For example, the adapter as illustrated in FIGS. 9 and 10 could be constructed with a knob for remote dispensing of the notepaper. Additionally, various toothed wheels could be employed.

What is claimed is:

1. An apparatus for holding notepaper on a writing utensil comprising:

a casing for retaining a writing means substantially centrally within said casing, said casing having a slot formed therein and a cap disposed at a first end of said casing;

a hollow cylindrical pin for carrying notepaper within said casing and wherein the writing means is receivable within said pin, said pin being in communication with said slot for dispensing notepaper from said pin through said casing;

a paper control lock for retaining the notepaper within said casing and restricting inadvertent movement of the notepaper, said paper control lock disposed adjacent an outer surface of said casing and including an extension extending into said slot; and means for advancing the notepaper including:

a knob disposed on said cap for remotely dispensing the notepaper, said knob including a counterbore formed therein;

a second, noncircular pin disposed on an end of said cylindrical pin adjacent said first end of said casing, said counterbore being configured to receive said second pin such that rotation of said knob rotates said second pin; and a toothed wheel for cooperating with said extension, said wheel including a bore formed therein for mating engagement with said second pin such that rotation of said second pin rotates said wheel, wherein movement of the teeth displaces said extension to thereby release said paper control lock and advance the notepaper.

* * * * *